US008744320B2

(12) United States Patent
Mihara et al.

(10) Patent No.: US 8,744,320 B2
(45) Date of Patent: Jun. 3, 2014

(54) DEVELOPING DEVICE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 263 days.

(21) Appl. No.: 13/325,513

(22) Filed: Dec. 14, 2011

(65) Prior Publication Data

US 2012/0163873 A1 Jun. 28, 2012

(30) Foreign Application Priority Data

Dec. 28, 2010 (JP) ..... P2010-294279

(51) Int. Cl.
*G03G 15/08* (2006.01)

(52) U.S. Cl.
USPC ..... 399/256

(58) Field of Classification Search
USPC ..... 399/254, 256
See application file for complete search history.

(56) References Cited

U.S. PATENT DOCUMENTS

| | | | | |
|---|---|---|---|---|
| 7,783,233 | B2 * | 8/2010 | Iwata et al. | 399/256 |
| 7,860,435 | B2 * | 12/2010 | Aimoto | 399/255 |
| 8,554,115 | B2 * | 10/2013 | Hayashi et al. | 399/256 |
| 2004/0179865 | A1 | 9/2004 | Nishiyama | |
| 2007/0025773 | A1 | 2/2007 | Tateyama et al. | |
| 2007/0274742 | A1 | 11/2007 | Nakayama et al. | |

FOREIGN PATENT DOCUMENTS

| | | |
|---|---|---|
| JP | 2004-272017 | 9/2004 |
| JP | 2007-34043 | 2/2007 |
| JP | 2007-316495 A | 12/2007 |
| JP | 2008-304846 | 12/2008 |
| JP | 2009-098621 A | 5/2009 |

* cited by examiner

*Primary Examiner* — David Gray
*Assistant Examiner* — Gregory H Curran
(74) *Attorney, Agent, or Firm* — Nixon & Vanderhye, P.C.

(57) ABSTRACT

In a developing device including a developer tank and a developing roller, an internal space of the developer tank is divided by a partition wall into a first conveying path, a second conveying path, a communication path and a pumping path. In the pumping path, there is disposed a developer pumping section including a pumping spiral blade, a pumping rotation shaft member, and a pumping gear. A developer in the pumping path is pumped up by the developer pumping section, so that a part of the developer is moved to a side of the first conveying path while another part of the developer is moved to a side of the second conveying path.

4 Claims, 13 Drawing Sheets

DEVELOPING DEVICE AND IMAGE FORMING APPARATUS

CROSS-REFERENCE TO RELATED APPLICATION

This application claims priority to Japanese Patent Application No. 2010-294279, which was filed on Dec. 28, 2010, the contents of which are incorporated herein by reference in its entirety.

BACKGROUND OF THE TECHNOLOGY

Field of the Technology

The present technology relates to a developing device and an image forming apparatus.

A copier, a printer, a facsimile machine or the like is provided with an image forming apparatus which forms an image employing electrophotography. The electrophotographic image forming apparatus forms an electrostatic latent image on a surface of an image bearing member (photoreceptor) by a charging device and an exposure device, supplies a developer by a developing device to develop the electrostatic latent image, transfers a developer image on the photoreceptor onto a recording medium such as a recording paper by a transfer section, and fixes the developer image to the recording paper by a fixing device to form an image.

The developer supplied to the photoreceptor by the developing device is stored in a developer tank disposed in the developing device. The developer stored in the developer tank is conveyed to a developing roller disposed in the developing device. The developing roller rotates with the developer borne on a surface thereof to supply the developer to the photoreceptor. The developer is charged by frictional electrification in the course of being conveyed to the developing roller. The charged developer moves onto the photoreceptor from the developing roller by electrostatic force between the charged developer and the electrostatic latent image on the surface of the photoreceptor. In this way, the developing device develops the electrostatic latent image on the surface of the photoreceptor to form the developer image.

In recent years, in accordance with the increased process speed of an image forming apparatus and the reduction in size thereof, there is a demand for a developing device which is capable of rapidly and sufficiently charging a developer. For example, Japanese Unexamined Patent Publication JP-A 2004-272017 discloses a circulation type developing device which includes a first conveying path, a second conveying path, a first communication path and a second communication path formed by a partition wall installed inside a developer tank, and a developer conveying section which conveys a developer through the first conveying path and the second conveying path in opposite directions. The developer conveying section disclosed in JP-A 2004-272017 has a structure of an auger screw including a rotation shaft member and a spiral blade spirally wound around the rotation shaft member, in which a plate-shaped member (fin) which is parallel with an axial line of the rotation shaft member is installed on the rotation shaft member.

The developer conveying section disclosed in JP-A 2004-272017 conveys the developer in an axial direction of the rotation shaft member by the spiral blade and moves the developer in a circumferential direction of the rotation shaft member by a main surface of the fin, to thereby frictionally charge the moving developer. However, in such a developer conveying section, there is a problem that the developer disposed between the spiral blade and a side surface of the fin is compressed and the compressed developer is not sufficiently frictionally charged. If the developer is not sufficiently charged, the image forming apparatus cannot form a high quality image.

SUMMARY OF THE TECHNOLOGY

The technology is made to solve the above-described problem, and an object thereof is to provide a developing device capable of charging a developer sufficiently, and an image forming apparatus.

The technology provides a developing device for storing a developer and supplying the developer to an image bearing member to develop an electrostatic latent image on the image bearing member, including:

a developer tank which stores therein the developer;

a partition wall which divides an internal space of the developer tank into:

- a first conveying path which is located along a longitudinal direction of the partition wall and extends in a substantially horizontal direction,
- a second conveying path which extends in the substantially horizontal direction and faces the first conveying path with the partition wall interposed therebetween,
- a communication path through which the first conveying path and the second conveying path communicate with each other on one end side in the longitudinal direction of the partition wall, and
- a pumping path through which the first conveying path and the second conveying path communicate with each other on another end side in the longitudinal direction of the partition wall and which extends in a substantially vertical direction;

a first developer conveying section disposed in the first conveying path, the first developer conveying section conveying the developer in the developer tank in the substantially horizontal direction, the first developer conveying section conveying the developer from the other end side to the one end side in the longitudinal direction of the partition wall;

a second developer conveying section disposed in the second conveying path, the second developer conveying section conveying the developer in the developer tank in the substantially horizontal direction, the second developer conveying section conveying the developer from the one end side to the other end side in the longitudinal direction of the partition wall; and a developer pumping section disposed in the pumping path, the developer pumping section pumping the developer in the pumping path toward an upper side in the substantially vertical direction of the pumping path, the developer pumping section moving part of the developer to a side of the first conveying path by pumping the developer in the pumping path, while moving other part of the developer to a side of the second conveying path.

In the pumping path, the developer is pumped toward an upper side in the substantially vertical direction of the pumping path against gravity by the developer pumping section. At this time, there occurs friction between the developer and the developer pumping section, and as a result, the developer is charged. Then, part of the developer having pumped to a vertically upper part of the pumping path is moved to the side of the first conveying path, while the other part of the developer is moved to the side of the second conveying path. Therefore, the other part of the developer is moved to the side of the second conveying path without passing through the first conveying path, thereby returning into the pumping path at a shorter distance compared with a case of passing through the first conveying path. That is, the developer circulates in a relatively short circulation path including the pumping path in which the developer is charged and not including the first conveying path. Therefore, the developing device according to the technology can be sufficiently charge and convey the developer.

Further, it is preferable that the partition wall includes:

a first opening portion in which an opening through which the second conveying path communicates with the pumping path is formed at a vertically lower part of the partition wall, a second opening portion in which an opening through which the first conveying path communicates with the pumping path is formed at a vertically upper part of the partition wall, and a third opening portion in which an opening through which the second conveying path communicates with the pumping path is formed at the vertically upper part of the partition wall, and the second developer conveying section moves the developer in the second conveying path into the pumping path through the first opening portion, and the developer pumping section moves the part of the developer in the pumping path into the first conveying path through the second opening portion, while moving the other part of the developer into the second conveying path through the third opening portion.

The developer pumping section moves the part of the developer in the pumping path into the first conveying path through the second opening portion disposed in the partition wall, while moving the other part of the developer in the pumping path into the second conveying path through the third opening portion disposed in the partition wall. Accordingly, the developer is circulation-conveyed in a circulation path including the second conveying path, an opening formed in the first opening portion, the pumping path and the opening formed in the third opening portion. Thereby, a size of the whole developing device can be reduced compared with a case where there is another space between the second conveying path and the pumping path.

Further, it is preferable that a vertically lower part of the opening formed in the second opening portion is disposed vertically above a vertically lower part of the first conveying path.

A vertically lower part of the opening formed in the second opening portion is disposed vertically above a vertically lower part of the first conveying path. Therefore, the developer can be moved into the first conveying path from inside the pumping path more smoothly compared with a case where the vertically lower part of the opening formed in the second opening portion is disposed vertically below the vertically lower part of the first conveying path.

Further, it is preferable that a vertically lower part of the pumping path is disposed vertically below a vertically lower part of the second conveying path.

A vertically lower part of the pumping path is disposed vertically below a vertically lower part of the second conveying path. Therefore, the developer can be moved from the inside of the second conveying path into the pumping path more smoothly compared with a case where the vertically lower part of the pumping path is disposed vertically above the vertically lower part of the second conveying path.

Further, it is preferable that a supply port section in which an opening is formed to communicate with the second conveying path is disposed in the developer tank, and the supply port section is disposed vertically above a part facing the pumping path in the second conveying path.

A supply port section is disposed vertically above a part facing the pumping path in the second conveying path. Accordingly, a new toner supplied at the supply port section is immediately guided into the pumping path. Therefore, the developing device according to the technology is capable of immediately and sufficiently charging a new toner that is freshly supplied into the developer tank in a relatively short circulation path including the pumping path.

Further, it is preferable that the second developer conveying section includes a rotating plate which rotates around a rotation axial line extending in the longitudinal direction, and the rotating plate is disposed in a part facing the pumping path in the second conveying path.

The second developer conveying section includes a rotating plate disposed in a part facing the pumping path in the second conveying path. Accordingly, the developer in the second conveying path can be guided into the pumping path immediately by the rotating plate. Thereby, the developer can be circulated effectively in the relatively short circulation path including the pumping path.

Further, the technology provides an electrophotographic image forming apparatus including the developing device mentioned above.

The image forming apparatus includes the above-described developing device, and thus, it is possible to sufficiently charge the developer by the developing device. Thus, it is possible to form a stable image with high quality.

BRIEF DESCRIPTION OF THE DRAWINGS

Other and further objects, features, and advantages of the technology will be more explicit from the following detailed description taken with reference to the drawings wherein:

FIGS. 12A to 12D are views illustrating one cyclic cone-shaped general spiral blade surface.

DETAILED DESCRIPTION

Figure 1:
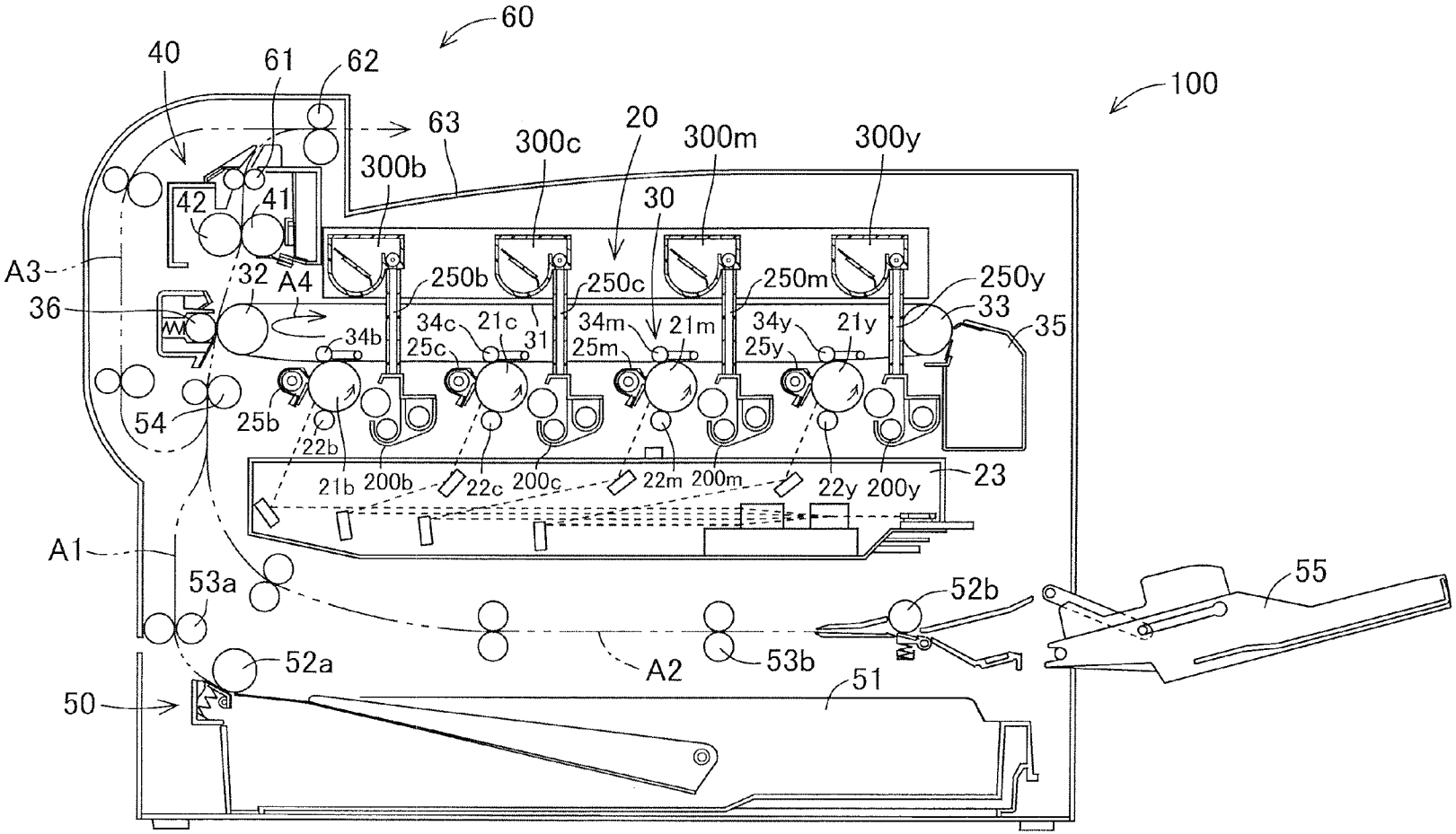
FIG. 1 is a schematic view showing a configuration of an image forming apparatus.

Now referring to the drawings, preferred embodiments are described below.

First, an image forming apparatus 100 having a developing device 200 according to a first embodiment will be described. FIG. 1 is a schematic view showing a configuration of the image forming apparatus 100. The image forming apparatus 100 is a multi-functional peripheral which has a copier function, a printer function, and a facsimile function. A full-color or monochrome image is formed on a recording medium in accordance with the image information transmitted to the image forming apparatus 100.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, and toner cartridges 300*b*, 300*c*, 300*m*, and 300*y*, and the toner supply pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250 and the intermediate transfer roller 34 are disposed in four sets so as to correspond to the image information of the respective colors of black (b), cyan (c), magenta (m), and yellow (y) which are included in the color image information. In this specification, when the four sets of respective components provided for the respective colors are distinguished, letters indicating the respective colors are affixed to the end of the numbers representing the respective components, and combinations of the numbers and alphabets are used as the reference numerals. When the respective components are collectively referred, only the numerals representing the respective components are used as the reference numerals.

The photoreceptor drum 21 is supported so as to be rotatable around an axial line thereof by a driving section (not shown) and includes a conductive substrate (not shown) and a photoconductive layer (not shown) formed on the surface of the conductive substrate.

The charging section 22, the developing device 200, and the cleaning unit 25 are disposed around the photoreceptor drum 21 in that order in a rotation direction thereof. The charging section 22 is disposed vertically below the developing device 200 and the cleaning unit 25.

The charging section 22 is a device that charges a surface of the photoreceptor drum 21 so as to have predetermined polarity and potential. The charging section 22 is disposed along a longitudinal direction of the photoreceptor drum 21 so as to face the photoreceptor drum 21.

The exposure unit 23 is disposed so that light emitted from the exposure unit 23 passes between the charging section 22 and the developing device 200 and reaches the surface of the photoreceptor drum 21.

The developing device 200 is a device that develops an electrostatic latent image formed on the photoreceptor drum 21 with a toner so as to form a toner image on the photoreceptor drum 21. To a vertically upper part of the developing device 200, the toner supply pipe 250 which is a tubular member is connected. Description for the developing device 200 will be given in detail below.

The toner cartridge 300 is arranged vertically above the developing device 200 and stores an unused toner. To a vertically lower part of the toner cartridge 300, the toner supply pipe 250 is connected. The toner cartridge 300 supplies a toner to the developing device 200 through the toner supply pipe 250. Description for the toner cartridge 300 will be given in detail below.

The cleaning unit 25 is a member which removes the toner which remains on the surface of the photoreceptor drum 21 after the toner image has been transferred from the photoreceptor drum 21 to the intermediate transfer belt 31, and thus cleans the surface of the photoreceptor drum 21.

According to the toner image forming section 20, the surface of the photoreceptor drum 21 which is evenly charged by the charging section 22 is irradiated with laser beams corresponding to the image information from the exposure unit 23, whereby electrostatic latent images are formed on the surface of the photoreceptor drum 21. The toner is supplied from the developing device 200 to the electrostatic latent images on the photoreceptor drum 21, whereby toner images are formed. The toner images are transferred to the intermediate transfer belt 31 described later. The toner which remains on the surface of the photoreceptor drum 21 after the toner images has been transferred to the intermediate transfer belt 31 is removed by the cleaning unit 25.

The intermediate transfer belt 31 is an endless belt-shaped member which is disposed vertically above the photoreceptor drum 21. The intermediate transfer belt 31 is supported around the driving roller 32 and the driven roller 33 with tension to form a loop-shaped path and is turned to run in the direction indicated by an arrow A4.

The driving roller 32 is disposed so as to be rotatable around an axial line thereof by a driving section (not shown). The intermediate transfer belt 31 is caused to turn by rotation of the driving roller 32 in the direction indicated by the arrow A4. The driven roller 33 is disposed so as to be rotatable in accordance with rotation of the driving roller 32 and generates a constant tension in the intermediate transfer belt 31 so that the intermediate transfer belt 31 does not go slack.

The intermediate transfer roller 34 is disposed so as to come into pressure-contact with the photoreceptor drum 21 with the intermediate transfer belt 31 interposed therebetween and be rotatable around an axial line thereof by a driving section (not shown). As for the intermediate transfer roller 34, one in which a conductive elastic member is formed on the surface of a roller made of metal (for example, stainless steel) having a diameter of 8 mm to 10 mm can be used, for example. The intermediate transfer roller 34 is connected to a power source (not shown) that applies a transfer bias and has a function of transferring the toner images on the surface of the photoreceptor drum 21 to the intermediate transfer belt 31.

The transfer roller 36 is disposed so as to come into pressure-contact with the driving roller 32 with the intermediate transfer belt 31 interposed therebetween and be rotatable around an axial line thereof by a driving section (not shown). In a pressure-contact portion (a transfer nip region) between the transfer roller 36 and the driving roller 32, the toner images which have been borne on the intermediate transfer belt 31 and conveyed to the pressure-contact portion are transferred to a recording medium fed from the recording medium feeding section 50 described later.

The transfer belt cleaning unit 35 is disposed so as to face the driven roller 33 with the intermediate transfer belt 31 interposed therebetween and come into contact with a toner image bearing surface of the intermediate transfer belt 31. The transfer belt cleaning unit 35 is disposed so as to remove and collect the toner which remains on the surface of the intermediate transfer belt 31 after the toner images have been transferred to the recording medium.

According to the transfer section 30, when the intermediate transfer belt 31 is turned to run while making contact with the photoreceptor drum 21, a transfer bias having a polarity opposite to the polarity of the charged toner on the surface of the photoreceptor drum 21 is applied to the intermediate transfer roller 34, and the toner images formed on the surface of the photoreceptor drum 21 are transferred to the intermediate transfer belt 31. The toner images of the respective colors formed by the respective photoreceptor drums 21*y*, 21*m*, 21*c*, and 21*b* are sequentially transferred and overlaid onto the intermediate transfer belt 31, whereby full-color toner images are formed. The toner images transferred to the intermediate transfer belt 31 are conveyed to the transfer nip region by turning movement of the intermediate transfer belt 31, and the toner images are transferred to the recording medium in the transfer nip region. The recording medium on which the toner images are transferred is conveyed to a fixing section 40 described later.

The recording medium feeding section 50 includes a paper feed box 51, pickup rollers 52*a* and 52*b*, conveying rollers 53*a* and 53*b*, registration rollers 54, and a paper feed tray 55. The paper feed box 51 is a container-shaped member which is disposed in a vertically lower part of the image forming apparatus 100 so as to store recording mediums at the inside of the image forming apparatus 100. The paper feed tray 55 is a tray-shaped member which is disposed on an outer wall surface of the image forming apparatus 100 so as to store recording mediums outside the image forming apparatus 100.

The pickup roller 52*a* is a member which takes out the recording mediums stored in the paper feed box 51 sheet by sheet and feeds the recording medium to a paper conveyance path A1. The conveying rollers 53*a* are a pair of roller-shaped members disposed so as to come into pressure-contact with each other, and convey the recording medium towards the registration rollers 54 along the paper conveyance path A1. The pickup roller 52*b* is a member which takes out the recording mediums stored in the paper feed tray 55 sheet by sheet and feeds the recording medium to a paper conveyance path A2. The conveying rollers 53*b* are a pair of roller-shaped members disposed so as to come into pressure-contact with each other, and convey the recording medium towards the registration roller 54 along the paper conveyance path A2.

The registration rollers 54 are a pair of roller-shaped members disposed so as to come into pressure-contact with each other, and feed the recording medium fed from the conveying rollers 53*a* and 53*b* to the transfer nip region in synchronization with the conveyance of the toner images borne on the intermediate transfer belt 31 to the transfer nip region.

According to the recording medium feeding section 50, the recording medium is fed from the paper feed box 51 or the paper feed tray 55 to the transfer nip region in synchronization with the conveyance of the toner images borne on the intermediate transfer belt 31 to the transfer nip region, and the toner images are transferred to the recording medium.

The fixing section 40 includes a heating roller 41 and a pressure roller 42. The heating roller 41 is controlled so as to maintain a predetermined fixing temperature. The pressure roller 42 is a roller that comes into pressure-contact with the heating roller 41. The heating roller 41 and the pressure roller 42 pinch the recording medium under application of heat, thus fusing the toner of the toner images so as to be fixed to the recording medium. The recording medium to which the toner images have been fixed is conveyed to the discharging section 60 described later.

The discharging section 60 includes conveying rollers 61, discharge rollers 62, and a catch tray 63. The conveying rollers 61 are a pair of roller-shaped members which is disposed vertically above the fixing section 40 so as to come into pressure-contact with each other. The conveying rollers 61 convey the recording medium on which images have been fixed towards the discharge rollers 62.

The discharge rollers 62 are a pair of roller-shaped members which is disposed so as to come into contact with each other. In the case of single-side printing, the discharge rollers 62 discharge a recording medium on which single-side printing has finished to the catch tray 63. In the case of double-side printing, the discharge rollers 62 convey a recording medium on which single-side printing has finished to the registration rollers 54 along a paper conveyance path A3 and then discharges a recording medium on which double-side printing has finished to the discharge tray 63. The catch tray 63 is disposed on the vertically upper surface of the image forming apparatus 100 so as to store recording mediums to which images have been fixed.

The image forming apparatus 100 includes the control unit section (not shown). The control unit section is disposed in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD).

The computing portion takes out various kinds of data (for example, image formation commands, detection results, and image information) written in the memory portion and the programs for various processes and then makes various determinations. The control portion sends a control signal to the respective devices disposed in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices disposed in the image forming apparatus 100.

Figure 2:
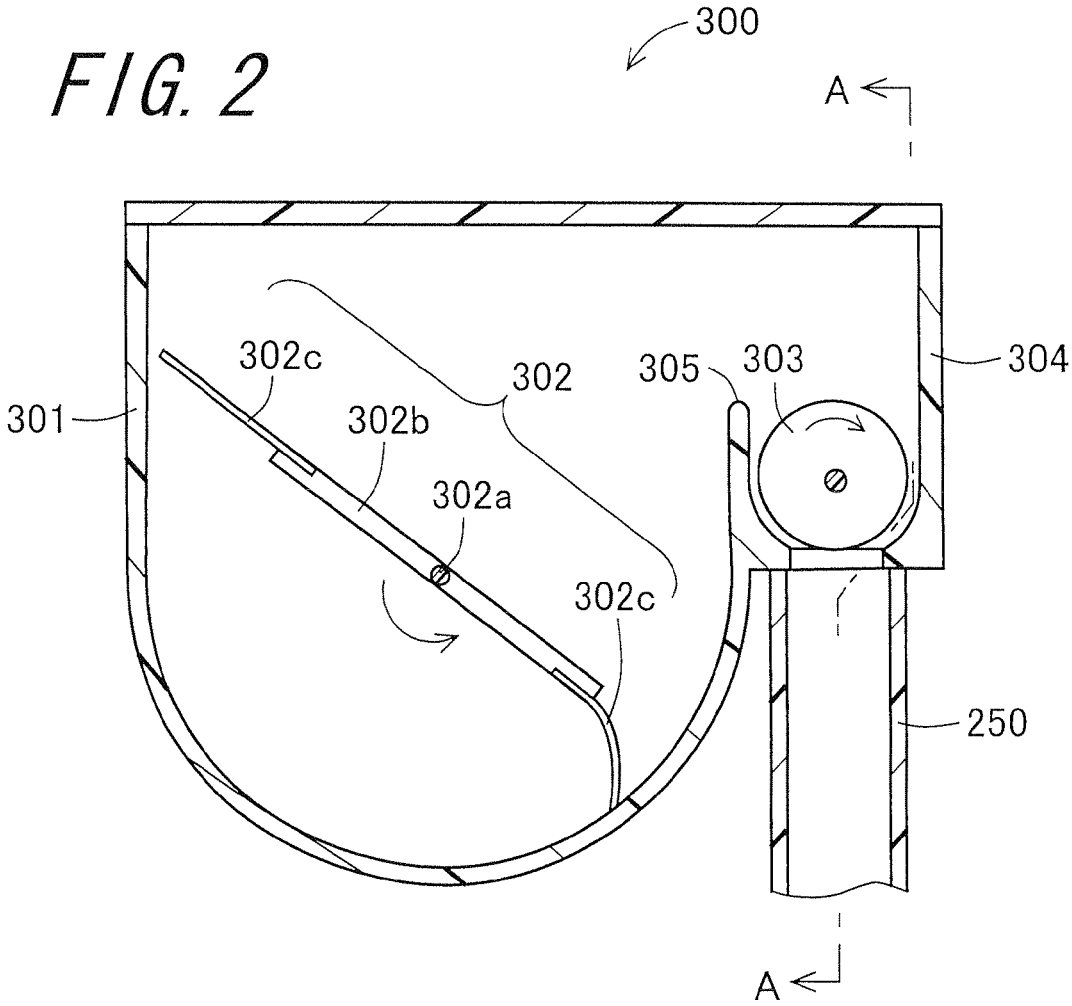
FIG. 2 is a schematic view showing a configuration of a toner cartridge.
Figure 3:
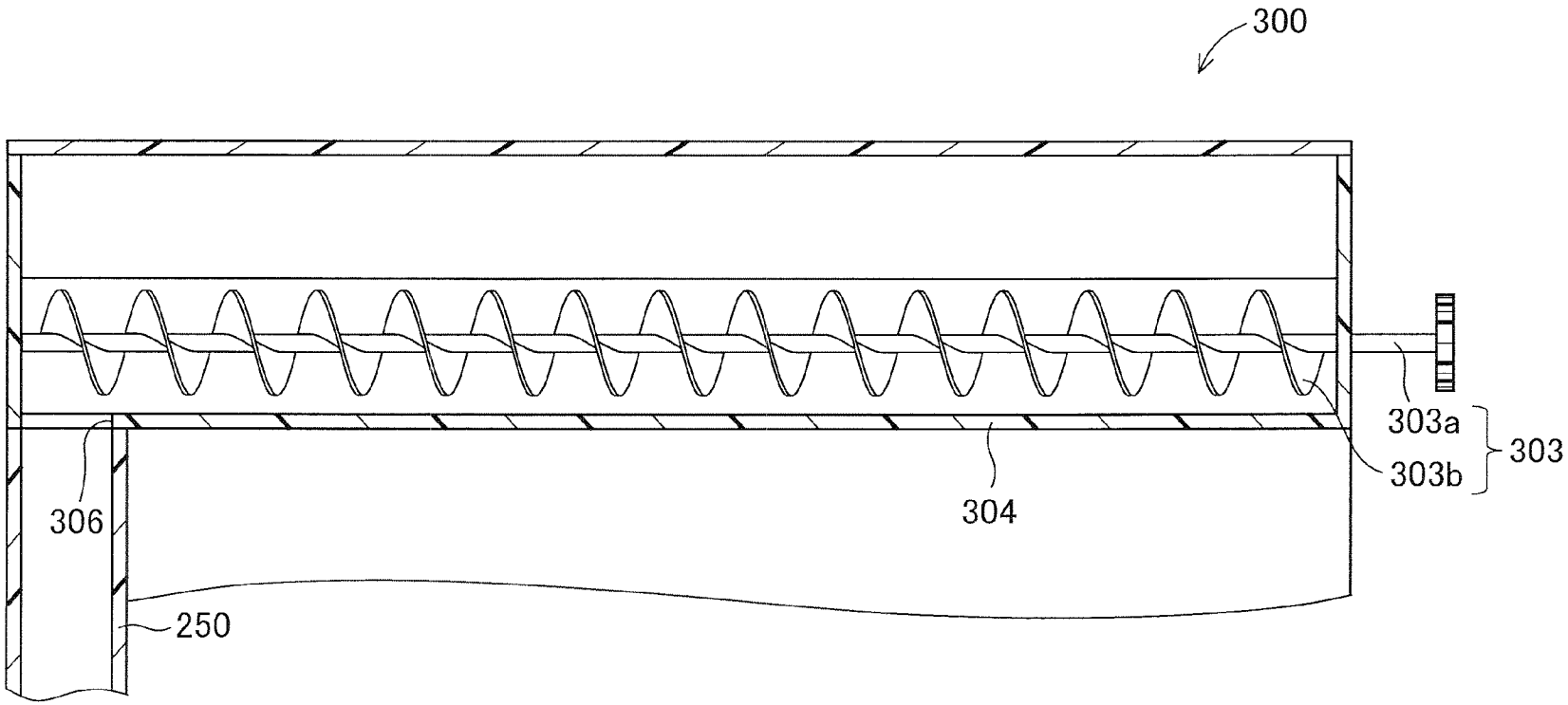
FIG. 3 is a cross-sectional view of the toner cartridge taken along the line A-A shown in FIG. 2.

FIG. 2 is a schematic view showing a configuration of the toner cartridge 300. FIG. 3 is a cross-sectional view of the toner cartridge 300 taken along the line A-A shown in FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both ends in the width direction of the base member 302*b*, and is formed of, for example, polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* disposed at the both ends in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* disposed around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
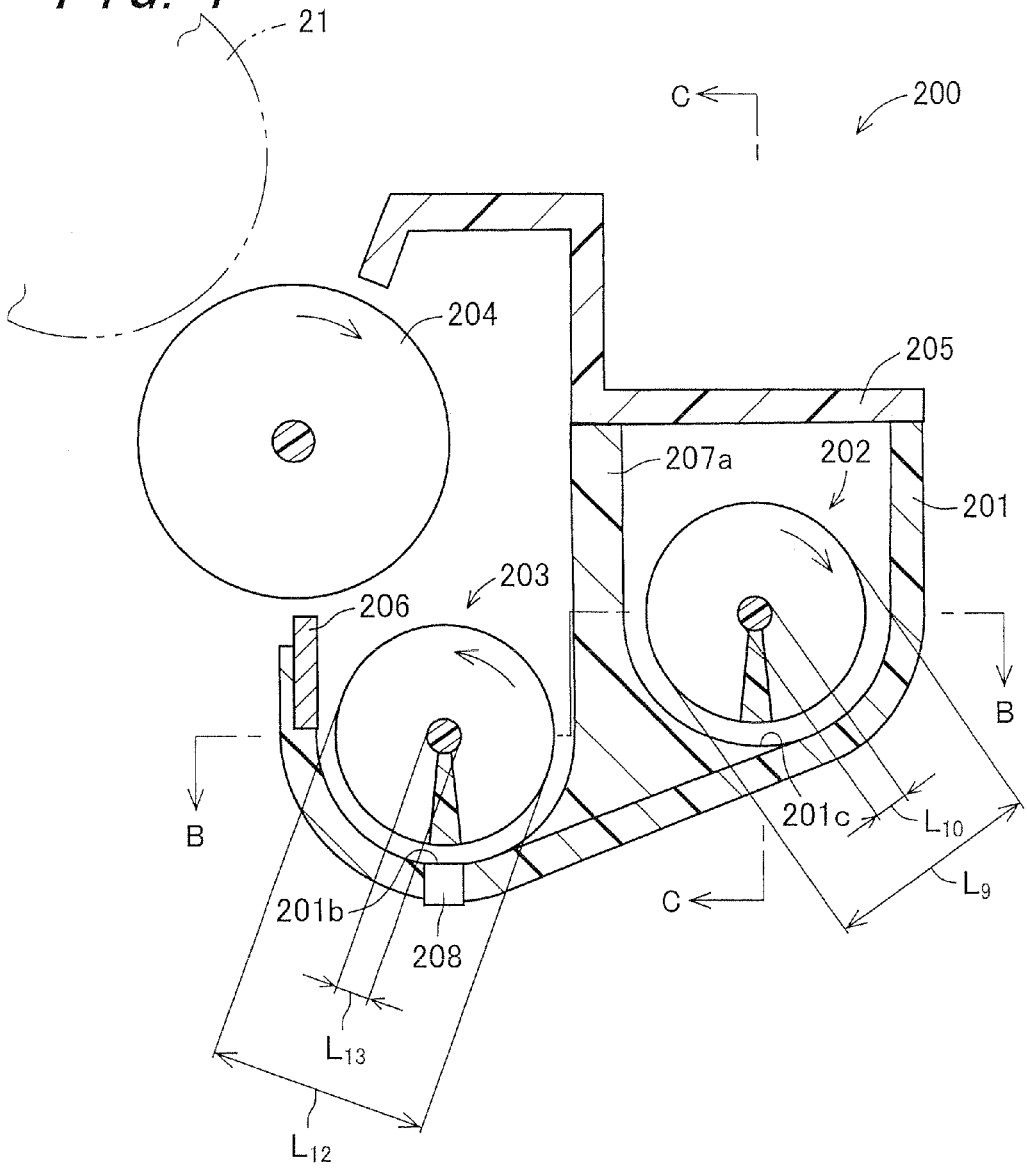
FIG. 4 is a schematic view showing a configuration of a developing device.
Figure 5:
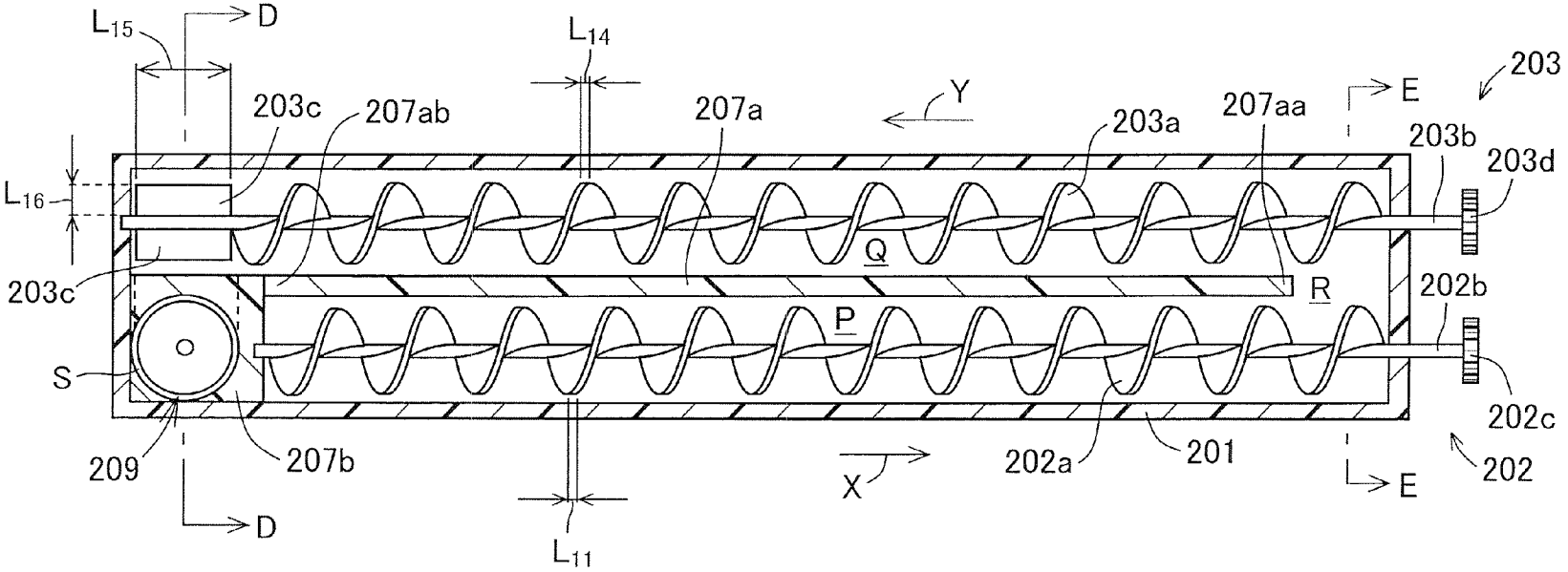
FIG. 5 is a view showing a part of the developing device taken along the line B-B shown in FIG. 4.
Figure 6:
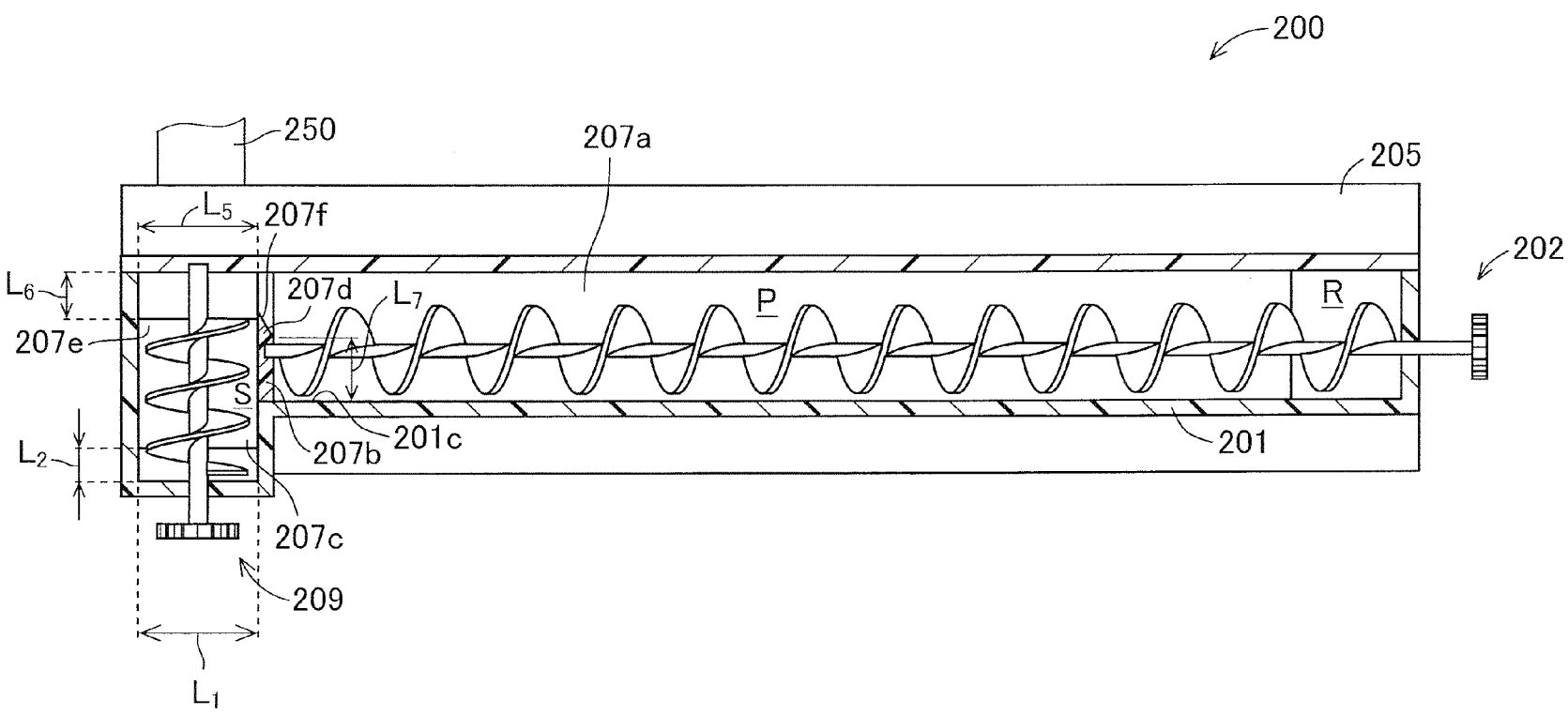
FIG. 6 is a view showing a part of the developing device taken along the line C-C shown in FIG. 4.
Figure 7:
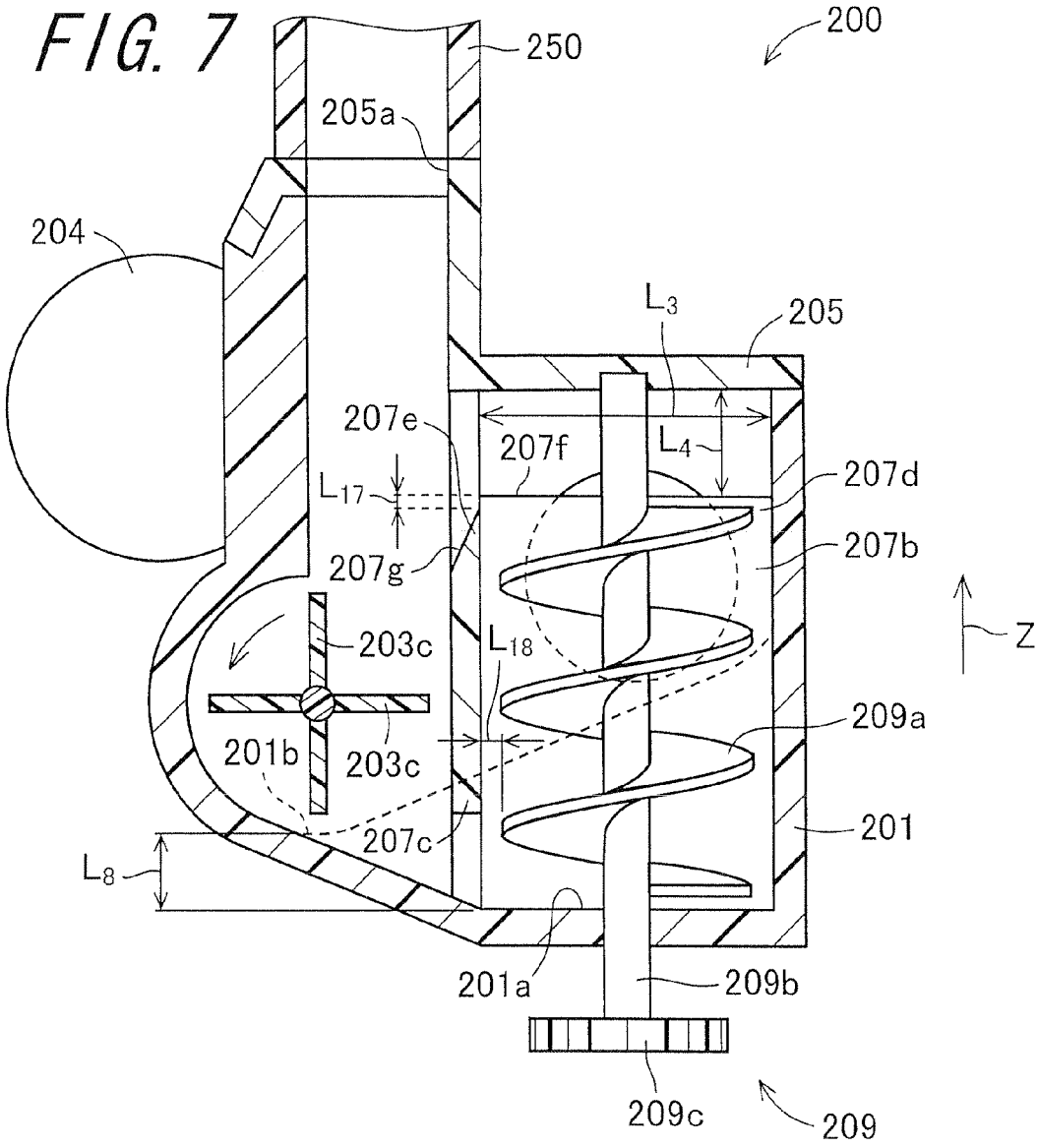
FIG. 7 is a view showing a part of the developing device taken along the line D-D shown in FIG. 5.
Figure 8:
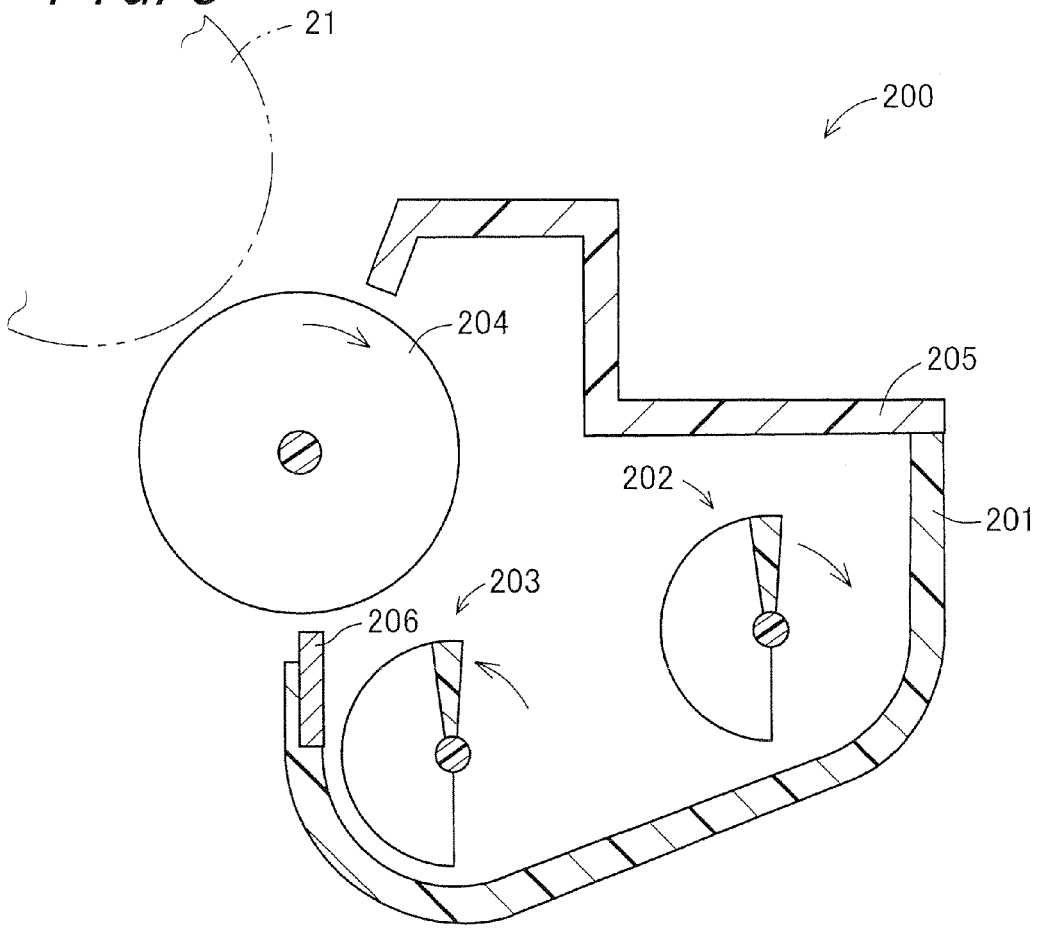
FIG. 8 is a cross-sectional view of the developing device taken along the line E-E shown in FIG. 5.

FIG. 4 is a schematic view showing a configuration of the developing device 200. FIG. 5 is a view showing a part of the developing device 200 taken along the line B-B shown in FIG. 4. FIG. 6 is a view showing a part of the developing device 200 taken along the line C-C shown in FIG. 4. FIG. 7 is a view showing a part of the developing device 200 taken along the line D-D shown in FIG. 5. FIG. 8 is a cross-sectional view of the developing device 200 taken along the line E-E shown in FIG. 5. The developing device 200 is a device that supplies a toner to a surface of the photoreceptor drum 21 to develop an electrostatic latent image formed on the surface of the photoreceptor drum 21. The developing device 200 includes a developer tank 201, a first developer conveying section 202, a second developer conveying section 203, a developing roller 204, a developer tank cover 205, a doctor blade 206, a partition wall 207, a toner concentration detecting sensor 208, and a developer pumping conveying section 209.

The developer tank 201 is a member having an internal space, and stores the developer in the internal space. The developer used in the embodiment may be a single-component developer composed of a toner, or may be a two-component developer composed of a toner and a carrier.

In the developer tank 201, the developer tank cover 205 is disposed on a vertically upper side, and in the internal space thereof, the first developer conveying section 202, the second developer conveying section 203, the developing roller 204, the doctor blade 206, the partition wall 207, and the developer pumping conveying section 209 are disposed. Further, in a vertically lower part (bottom part) of the developer tank 201, the toner concentration detecting sensor 208 is disposed. Further, the developer tank 201 has an opening section between the photoreceptor drum 21 and the developing roller 204.

The developing roller 204 includes a magnet roller, bears the developer in the developer tank 201 on a surface thereof, and then supplies the toner included in the borne developer to the photoreceptor drum 21. A power source (not shown) is connected to the developing roller 204, and applies a developing bias voltage thereto. The toner borne by the developing roller 204 is moved to the photoreceptor drum 21 by electrostatic force due to the developing bias voltage around the photoreceptor drum 21.

The doctor blade 206 is a plate-like member extending in an axial line direction of the developing roller 204, and is disposed so that one end in a width direction thereof is fixed to the developer tank 201, and another end thereof has a clearance with respect to the surface of the developing roller 204. The doctor blade 206 is disposed so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The partition wall 207 is a member that divides the internal space of the developer tank 201, and has a horizontal partition wall 207*a* and a vertical partition wall 207*b*. The horizontal partition wall 207*a* is an approximately U-shaped member which extends in a substantially horizontal direction. In the embodiment, the "substantially horizontal direction" means that it has at least a horizontal direction component, and that the horizontal direction component is larger than the vertical direction component in a case where it also has a vertical direction component. The vertical partition wall 207*b* is a tubular member which extending in the substantially vertical direction, and an outer wall surface of the vertical partition wall 207*b* has a shape of a side surface of a rectangular parallelepiped, and an inner wall surface of the vertical partition wall 207*b* has a shape of a side surface of a circular column. In the embodiment, "substantially vertical direction" means that it has at least a vertical direction component, and that the vertical direction component is larger than the horizontal direction component in a case where it also has a horizontal direction component.

One end 207*aa* of the horizontal partition wall 207*a* in a longitudinal direction thereof is disposed so as to be spaced from an inner wall of the developer tank 201, and another end 207*ab* of the horizontal partition wall 207*a* in the longitudinal direction thereof is connected to the vertical partition wall 207*b*. The internal space of the developer tank 201 is divided into a first conveying path P, a second conveying path Q, a communication path R, and a pumping path S by the horizontal partition wall 207*a* and the vertical partition wall 207*b*.

The first conveying path P is an approximately semicircular cylindrical space which extends in the substantially horizontal direction along a longitudinal direction of the horizontal partition wall 207*a*. The second conveying path Q is formed vertically below the first conveying path P, and is an approximately semicircular cylindrical space which extends in the substantially vertical direction, which is a space which faces the first conveying path P with the horizontal partition wall 207*a* interposed therebetween. Note that, as another embodiment, the first conveying path P and the second conveying path Q may be formed at a same position vertically.

The communication path R is a space where the first conveying path P and the second conveying path Q communicate with each other on the side of the one end 207*aa* of the horizontal partition wall 207*a* in the longitudinal direction thereof. The pumping path S is a space where the first conveying path P and the second conveying path Q communicate with each other on the side of the other end 207*ab* of the horizontal partition wall 207*a* in the longitudinal direction thereof, and is a space where it extends in the substantially vertical direction. More specifically, the pumping path S is a space surrounded by the inner wall surface of the vertical partition wall 207*b*, in which a first opening portion 207*c* is disposed in a part facing the second conveying path Q at a vertically lower part of the vertical partition wall 207*b*, a third opening portion 207*e* is disposed in a part facing the second conveying path Q at a vertically upper part of the vertical partition wall 207*b*, and a second opening portion 207*d* is disposed in a part facing the first conveying path P at a vertically upper part of the vertical partition wall 207*b*. The second conveying path Q then communicates with the pumping path S through an opening formed in the first opening portion 207*c*. Moreover, the first conveying path P communicates with the pumping path S through an opening formed in the second opening portion 207*d*. Furthermore, the second conveying path Q communicates with the pumping path S through an opening formed in the third opening portion 207*e*.

The opening formed in the first opening portion 207*c* has an approximately rectangular shape, and a length $L_1$ of a long-side part thereof is settable as appropriate within a range of 15 mm or more and 35 mm or less, and a length $L_2$ of a short-side part thereof is settable as appropriate within a range of 5 mm or more and 20 mm or less. The opening formed in the second opening portion 207*d* has an approximately rectangular shape, and a length $L_3$ of a long-side part thereof is settable as appropriate within a range of 15 mm or more and 35 mm or less, and a length $L_4$ of a short-side part thereof is settable as appropriate within a range of 5 mm or more and 30 mm or less. The opening formed in the third opening portion 207*e* has an approximately rectangular shape, and a length $L_5$ of a long-side part thereof is settable as appropriate within a range of 15 mm or more and 35 mm or less, and a length $L_6$ of a short-side part thereof is settable as appropriate within a range of 5 mm or more and 30 mm or less.

The second opening portion 207*d* and the third opening portion 207*e* are disposed at almost a same position vertically. More specifically, a vertical distance $L_{17}$ between a part vertically below the opening in the second opening portion 207*d* and on a side of the pumping path S, and a part vertically below the opening in the third opening portion 207*e* and on a side of the pumping path S is settable as appropriate within a range of 0 mm or more and 15 mm or less. Note that, the second opening portion 207*d* may be formed vertically above, and the third opening portion 207*e* may be formed vertically above.

A face 207*f* vertically below the opening in the second opening portion 207*d* is formed to be inclined toward a horizontal surface so that a side of the first conveying path P comes to the vertically lower side of a side of the pumping path S. Furthermore, a surface 207*g* vertically below the opening in the third opening portion 207*e* is formed to be inclined toward the horizontal surface so that a side of the second conveying path Q comes to the vertically lower side of a side of the pumping path S.

A vertically lower part of the opening formed in the second opening portion 207*d* is formed vertically above a vertically lower part of the first conveying path P. That is, the face 207*f* vertically below the opening in the second opening portion 207*d* is formed vertically above a face 201*c* facing the first conveying path P at the bottom of the developer tank 201. A vertical distance $L_7$ between the face 207*f* vertically below the opening in the second opening portion 207*d* and the face 201*c* facing the first conveying path P at the bottom of the developer tank 201 is settable as appropriate within a range of 5 mm or more and 25 mm or less.

A vertically lower part of the pumping path S is formed vertically below a vertically lower part of the second conveying path Q. That is, at the bottom of the developer tank 201, a face 201*a* facing the pumping path S is formed vertically below the face 201*b* facing the second conveying path Q. A vertical distance $L_8$ between the face 201*a* facing the pumping path S and the face 201*d* facing the second conveying path Q is settable as appropriate within a range of 5 mm or more and 25 mm or less.

The developer tank cover 205 is detachably disposed on the vertically upper side of the developer tank 201, and has a supply port section 205*a* through which a toner is supplied into the developer tank 201. The supply port section 205*a* is an opening portion in which an opening which communicates with the second conveying path Q is formed. The supply port section 205*a* is disposed vertically above the part facing the pumping path S in the second conveying path Q. In the developer tank cover 205, a toner supply pipe 250 is connected to the supply port section 205*a*, and a toner contained in the toner cartridge 300 is supplied into the developer tank 201 through the toner supply pipe 250 and the opening formed in the supply port section 205*a*.

The toner concentration detecting sensor 208 is mounted on a bottom part of the developer tank 201 which faces a central portion of the second conveying path Q in the conveyance direction Y so that a sensing surface thereof is exposed to the second conveying path Q. The toner concentration detecting sensor 208 is electrically connected to a toner concentration control section (not shown).

The toner concentration control section performs control of rotating a toner discharge member 303 of the toner cartridge 300 according to the toner concentration detecting result detected by the toner concentration detecting sensor 208 and supplying the toner into the developer tank 201. More specifically, the toner concentration control section determines whether the toner concentration detecting result through the toner concentration detecting sensor 208 is lower than a predetermined set value. In a case where it is determined that the toner concentration detecting result is lower than the predetermined set value, the toner concentration control section sends a control signal to a driving section which rotates the toner discharge member 303, and rotates the toner discharge member 303 for a predetermined period.

A power source (not shown) is connected to the toner concentration detecting sensor 208. The power source applies a driving voltage for driving the toner concentration detecting sensor 208 and a control voltage for outputting the toner concentration detecting result to the toner concentration control section to the toner concentration detecting sensor 208. Application of voltage to the toner concentration detecting sensor 208 by the power source is controlled according to a control section (not shown).

As the toner concentration detecting sensor 208, a general toner concentration detecting sensor may be used, for example, a transmitted light detecting sensor, a reflected light detecting sensor, a magnetic permeability detecting sensor, or the like may be used. It is preferable that the magnetic permeability detecting sensor is used among these toner concentration detecting sensors. As the magnetic permeability detecting sensor, for example, TS-L (product name, manufactured by TDK corporation), TS-A (product name, manufactured by TDK corporation), TS-K (product name, manufactured by TDK corporation), or the like may be used.

The first developer conveying section 202 is disposed in the first conveying path P. The first developer conveying section 202 conveys a developer in the developer tank 201 in the substantially horizontal direction from the side of the other end 207*ab* in the longitudinal direction toward the side of the one end 207*aa* in the longitudinal direction of the horizontal partition wall 207*a*. Hereinafter, a conveyance direction of the developer by the first developer conveying section 202 is referred to as a conveyance direction X.

The first developer conveying section 202 is an auger screw shaped member, and includes a first spiral blade 202*a*, a first rotation shaft member 202*b* and a first gear 202*c*. The first rotation shaft member 202*b* is a cylindrical member which extends in the conveyance direction X, one end in a longitudinal direction thereof is connected to the first gear 202*c* outside the developer tank 201, and another end in the longitudinal direction thereof is rotatably supported by the vertical partition wall 207*b*.

The first spiral blade 202*a* has a shape spirally wound around the first rotation shaft member 202*b*, and rotates with 60 rpm to 180 rpm around an axial line of the first rotation shaft member 202*b*, through the first rotation shaft member 202*b* and the first gear 202*c* by a driving section such as a motor. The developer stored in the first conveying path P is conveyed to a downstream side in the conveyance direction X, by rotation of the first spiral blade 202*a*. The developer conveyed to the downstream side in the conveyance direction X moves to the communication path R, drops downward in the vertical direction in the communication path R, and moves to the lower conveying path Q.

A value of two times the distance between the axial line of the first rotation shaft member 202*b* and a point on the first spiral blade 202*a* which is the most distant therefrom is referred to as an external diameter $L_9$ of the first spiral blade 202*a*. Further, a value of two times the distance between the axial line of the first rotation shaft member 202*b* and a point on the first spiral blade 202*a* which is the closest thereto is referred to as an internal diameter $L_{10}$ of the first spiral blade 202*a*. The external diameter $L_9$ of the first spiral blade 202*a* is settable as appropriate in the range of 15 mm or more and 35 mm or less, and the internal diameter $L_{10}$ of the first spiral blade 202*a* is settable as appropriate in the range of 5 mm or more and 15 mm or less. Further, a thickness $L_n$ of the first spiral blade 202*a* is settable as appropriate in the range of 1 mm or more and 3 mm or less.

The second developer conveying section 203 is disposed in the second conveying path Q. The second developer conveying section 203 conveys a developer in the developer tank 201 in the substantially horizontal direction from the side of the one end 207*aa* in the longitudinal direction toward the side of the other end 207*ab* in the longitudinal direction of the horizontal partition wall 207*a*. Hereinafter, the conveyance direction of the developer by the second developer conveying section 203 is referred to as a conveyance direction Y.

The second developer conveying section 203 includes a second spiral blade 203*a*, a second rotation shaft member 203*b*, four rotating plates 203*c* and a second gear 203*d*. The second rotation shaft member 203*b* is a cylindrical member which extends in the conveyance direction Y, one end in a longitudinal direction thereof is connected to the second gear 203*d* outside the developer tank 201, and another end in the longitudinal direction thereof is rotatably supported by the vertical partition wall 207*b*.

The second spiral blade 203*a* is a shape spirally wound around the second rotation shaft member 203*b*, and rotates with 60 rpm to 180 rpm around an axial line of the second rotation shaft member 203*b*, through the second rotation shaft member 203*b* and the second gear 203*d* by a driving section such as a motor. The developer stored in the second conveying path Q is conveyed to a downstream side in the conveyance direction Y, by rotation of the second spiral blade 203*a*.

The four rotating plates 203*c* are composed of rectangular flat plates in the same shape, and long-side parts thereof are fixed to the second rotation shaft member 203*b*. The rotating plates 203*c* are disposed in a portion facing the pumping path S in the second conveying path Q. The four rotating plates 203*c* are fixed to the second rotation shaft member 203*b* so that main surfaces of the two neighboring rotating plates 203*c* are orthogonal to each other, and rotates with the second spiral blade 203*a* around an axial line of the second rotation shaft member 203*b*.

The developer conveyed from an upstream side in the conveyance direction Y in the second conveying path Q is forced to the side of the vertical partition wall 207*b* by rotation of the rotating plate 203*c*, and moves into the pumping path S through the opening formed in the first opening portion 207*c* of the vertical partition wall 207*b*. Note that, as another embodiment, the second developer conveying section 203 may be an auger screw-like member without the rotating plates 203*c*.

A value of two times the distance between the axial line of the second rotation shaft member 203*b* and a point on the second spiral blade 203*a* which is the most distant therefrom is referred to as an external diameter $L_{12}$ of the second spiral blade 203*a*. Further, a value of two times the distance between the axial line of the second rotation shaft member 203*b* and a point on the second spiral blade 203*a* which is the closest thereto is referred to as an internal diameter $L_{13}$ of the second spiral blade 203*a*. The external diameter $L_{12}$ of the second spiral blade 203*a* is settable as appropriate in the range of 15 mm or more and 35 mm or less, and the internal diameter $L_{13}$ of the second spiral blade 203*a* is settable as appropriate in the range of 5 mm or more and 15 mm or less. Further, a thickness $L_{14}$ of the second spiral blade 203*a* is settable as appropriate in the range of 1 mm or more and 3 mm or less. A length $L_{15}$ of the long-side part of the rotating plate 203*c* is settable as appropriate in the range of 15 mm or more and 35 mm or less, and a length $L_{16}$ of the short-side thereof is settable as appropriate in the range of 5 mm or more and 15 mm or less.

The developer pumping section 209 is disposed in the pumping path S. The developer pumping section 209 pumps a developer in the pumping path S substantially toward a vertically upper side indicated by an arrow Z in FIG. 7, so that a part of the developer in the pumping path S is moved to the side of the first conveying path P, and another part of the developer in the pumping path S is moved to the side of the second conveying path Q. More specifically, the developer pumping section 209 moves the part of the developer in the pumping path S into the first conveying path P through the second opening portion 207*d* disposed in the vertical partition wall 207*b*, and the other part of the developer in the pumping path S into the second conveying path Q through the third opening portion 207*e* disposed in the vertical partition wall 207*b*.

The developer pumping section 209 includes a pumping spiral blade 209*a*, a pumping rotation shaft member 209*b* and a pumping gear 209*c*. The pumping rotation shaft member 209*b* is a cylindrical member which extends in the substantially vertical direction, one end in the longitudinal direction thereof is connected to the pumping gear 209*c* outside the developer tank 201, and another end in the longitudinal direction thereof is rotatably supported by the developer tank cover 205. The pumping spiral blade 209*a* is a member having a shape spirally wound around of an imaginary circular column which extends in the substantially vertical direction, and in the embodiment, is spirally wound around the cylindrical pumping rotation shaft member 209*b*.

A distance $L_{18}$ between the pumping spiral blade 209*a* and the vertical partition wall 207*b* surrounding the pumping spiral blade 209*a* is settable as appropriate in the range of 1 mm or more and 2 mm or less. The pumping spiral blade 209*a* is disposed so as to extend vertically from the vertically lower part of the pumping path S to the position of the second opening portion 207*d* and the third opening portion 207*e*.

The pumping spiral blade 209*a* rotates with 60 rpm to 180 rpm around the axial line of the above-described imaginary circular column by a driving section such as a motor through the pumping rotation shaft member 209*b* and the pumping gear 209*c*. The developer stored in the pumping path S is forced substantially to the vertically upper side by rotation of the pumping spiral blade 209*a*. The distance $L_{18}$ between the pumping spiral blade 209*a* and the vertical partition wall 207*b* surrounding the pumping spiral blade 209*a* is 1 mm or more and 2 mm or less, therefore, the developer forced up by the pumping spiral blade 209*a* moves substantially to the vertically upper side. A part of the developer that move to the vertically upper side reaches the second opening portion 207*d* so as to move to the first conveying path P with own flowability. Moreover, another part of the developer that moves to the vertically upper side reaches the third opening portion 207*e* so as to move to the second conveying path Q with own flowability.

Figure 9:
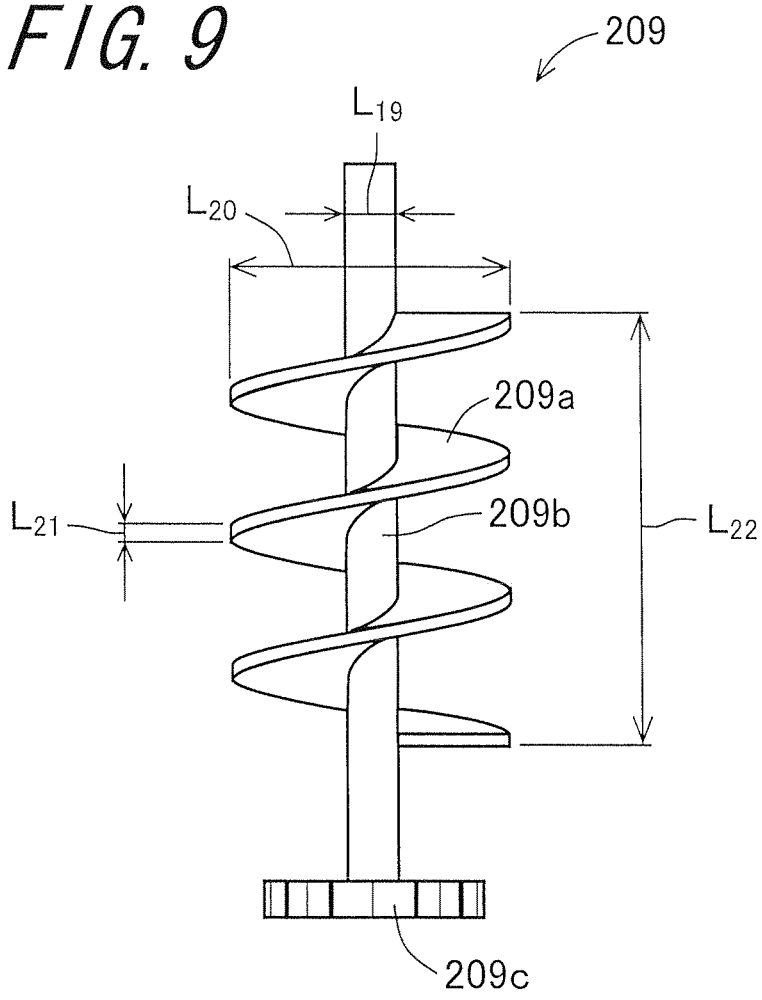
FIG. 9 is a schematic view showing an entire developer pumping section.

Hereinafter, description will be given in detail for the developer pumping section 209. FIG. 9 is a schematic view showing the entire developer pumping section 209. As described above, the developer pumping section 209 includes the pumping spiral blade 209*a*, the pumping rotation shaft member 209*b*, and the pumping gear 209*c*.

The pumping spiral blade 209*a*, the pumping rotational tube 209*b*, and the pumping gear 209*c* are formed of a material such as polyethylene, polypropylene, high impact polystyrene, or ABS resin (acrylonitrile-butadiene-styrene copolymer synthetic resin). In a case where the materials of the pumping spiral blade 209*a*, the pumping rotation shaft member 209*b*, and the pumping gear 209*c* are the same, it is preferable that the developer pumping conveying section 209 is integrally formed.

In the embodiment, the pumping spiral blade 209*a* is a continuous general spiral blade. In the embodiment, the "general spiral blade" approximately refers to a blade portion of an auger screw, and more specifically, refers to a member having a predetermined thickness and having a general spiral blade surface as a main surface. The general spiral blade surface is a curved surface corresponding to a spiral which is a curve, and details thereof will be described later.

In this embodiment, a "spiral" is a consecutive space curve on a side surface of an imaginary circular column, and a space curve that advances in one direction among axial line directions of the imaginary circular column while advancing in one direction among circumferential directions of the imaginary circular column. In the case of being viewed on the one direction among the axial line directions of the imaginary circular column, the spiral advancing in a right-handed direction among circumferential directions of the imaginary circular column while advancing in the one direction among the axial line directions of the imaginary circular column is referred to as being a right-handed spiral, whereas a spiral advancing in the left-handed direction while advancing in the one direction among the axial line directions of the imaginary circular column is referred to as being a left-handed spiral.

Further, among the spirals, a spiral whose lead angle is constant in all points on the spiral is especially referred to as a "general spiral". Here, an angle formed of a tangent line of the spiral at a certain point on the spiral and a straight line that is made by projecting the tangent line to a vertical plane with respect to the axial line direction of the imaginary circular column surrounded by the spiral is a "lead angle" at the point. The lead angle is an angle that is larger than 0° and smaller than 90°.

In this embodiment, the "general spiral blade surface" is a surface formed of the trajectory of one line segment $J_1$ outside an imaginary circular column $K_1$ (hereinafter a radius is $r_1$) when the line segment $J_1$ is moved in one direction $D_1$ parallel to the axial line of the imaginary circular column $K_1$ while maintaining a length $m_1$ of the line segment $J_1$ in a radial direction of the imaginary circular column $K_1$ and an attachment angle $\alpha$ of the line segment $J_1$ along one general spiral $C_1$ (hereinafter, a lead angle is constant at $\theta_1$) on a side surface of the imaginary circular column $K_1$. Here, the "attachment angle $\alpha$" is an angle formed by the line segment $J_1$ and a half-line extending in the one direction $D_1$ from a tangent point of the line segment $J_1$ and the imaginary circular column $K_1$ on a plane including the axial line of the imaginary circular column $K_1$ and the line segment $J_1$, and is an angle that is larger than 0° and smaller than 180°.

Figure 10A:
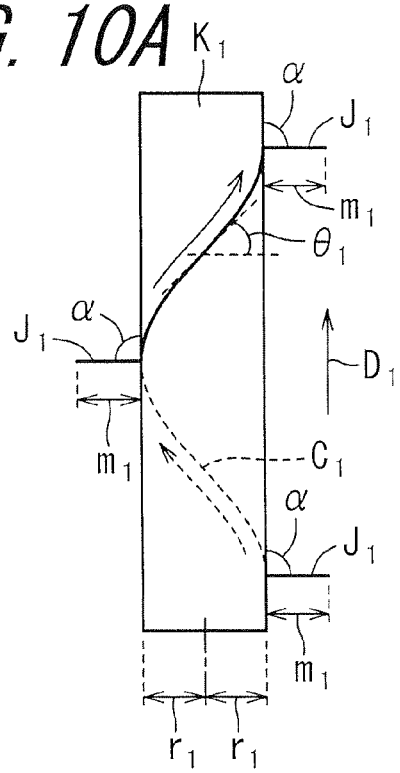
FIGS. 10A and 10B are views illustrating one cyclic general spiral blade surface.
Figure 10B:
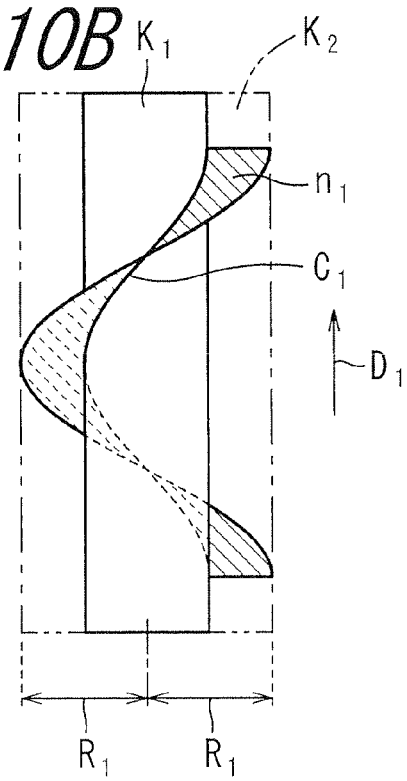

Hereinafter, as an example of the general spiral blade surface, a general spiral blade obtained when a line segment is moved along one cyclic portion of a general spiral (hereinafter, referred to as "one cyclic general spiral blade surface") is illustrated. FIGS. 10A and 10B are views illustrating one cyclic general spiral blade surface. FIG. 10A shows the side surface of the imaginary circular column $K_1$, the right-handed general spiral $C_1$ on the side surface of the imaginary circular column $K_1$, and the starting and ending positions of the line segment $J_1$ moving in one direction $D_1$ on the general spiral $C_1$. The line segment $J_1$ shown on the lowermost side of the sheet surface of FIG. 10A is the starting position of the moving line segment $J_1$, and the line segment $J_1$ shown on the uppermost side is the ending position. As shown in FIG. 10A, the trajectory of the line segment $J_1$ when the line segment $J_1$ is moved in one direction $D_1$ along the general spiral $C_1$ while constantly maintaining the length $m_1$ in the radial direction of the imaginary circular column $K_1$ and the attachment angle $\alpha$ ($\alpha$=90° in FIG. 10A) of the line segment $J_1$ corresponds to a general spiral blade surface $n_1$ shown in FIG. 10B. The surface depicted by a hatched portion in FIG. 10B is the general spiral blade surface $n_1$.

As shown in FIG. 10B, an outer circumferential portion of the general spiral blade surface $n_1$ becomes a right-handed general spiral that advances in the one direction $D_1$ on a side surface of an imaginary circular column $K_2$ whose axial line is identical with that of the imaginary circular column $K_1$. Here, the outer circumferential portion of the general spiral blade surface $n_1$ is a portion which is the most distant from the axial line of the imaginary circular column $K_1$ on the general spiral blade surface $n_1$. A radius $R_1$ of the imaginary circular column $K_2$ is equal to the sum of a radius $r_1$ of the imaginary circular column $K_1$ and the length $m_1$ of the line segment $J_1$ in the radial direction of the imaginary circular column $K_1$.

The member with such a general spiral blade surface as the main surface is the general spiral blade. In a case where the general spiral blade is used as the pumping spiral blade 209*a* as in the embodiment, the general spiral blade is formed so that the general spiral blade surface $n_1$ is placed on the vertically upper side, and a developer is conveyed toward the vertically upper side by the general spiral blade surface $n_1$.

Further, in a case where the general spiral blade is used as the pumping spiral blade 209*a*, an internal diameter $L_{19}$ of the pumping spiral blade 209*a* (general spiral blade) becomes a value of two times the radius $r_1$ of the imaginary circular column $K_1$ shown in FIG. 10A, and an external diameter $L_{20}$ thereof becomes a value of two times the radius $R_1$ of the imaginary circular column $K_2$ shown in FIG. 10B. Here, the internal diameter $L_{19}$ of the pumping spiral blade 209*a* (general spiral blade) is a value of two times the distance between an inner circumferential portion of the pumping spiral blade 209*a* (general spiral blade) and the axial line of the imaginary circular column $K_1$. The inner circumferential portion is a part on the pumping spiral blade 209*a* (general spiral blade) in which the distance from the axial line of the imaginary circular column $K_1$ is the closest thereto in a cross section perpendicular to the axial line of the imaginary circular column $K_1$. Further, the external diameter $L_{20}$ of the pumping spiral blade 209*a* (general spiral blade) is a value of two times the distance between the outer circumferential portion of the pumping spiral blade 209*a* (general spiral blade) and the axial line of the imaginary circular column $K_1$. The outer circumferential portion is a part on the pumping spiral blade 209*a* (general spiral blade) in which the distance from the axial line of the imaginary circular column $K_1$ is the most distant therefrom in the cross section perpendicular to the axial line of the imaginary circular column $K_1$.

The internal diameter $L_{19}$ of the pumping spiral blade 209*a* is settable as appropriate in the range of 5 mm or more and 15 mm or less, for example, and the external diameter $L_{20}$ is settable as appropriate in the range of 15 mm or more and 33 mm or less, for example. Further, for example, the attachment angle $\alpha$ may not be 90°, and is settable as appropriate in the range of 30° or more and 150° or less. The lead angle $\theta_1$ is settable as appropriate in the range of 20° or more and 70° or less, for example. Further, a thickness $L_{21}$ of the pumping spiral blade 209*a* is settable as appropriate in the range of 1 mm or more and 3 mm or less, and an entire length $L_{22}$ of the pumping spiral blade 209*a* in the longitudinal direction thereof is settable as appropriate in the range of 40 mm or more and 100 mm or less.

According to the developing device 200 provided with the developer pumping section 209 configured in this manner, in the developer tank 201, the developer is circulation-conveyed in a circulation path composed of the first conveying path P, the communication path R, the second conveying path Q and the pumping path S. More specifically, the developer is conveyed to the downstream side in the conveyance direction X by the first developer conveying section 202 in the first conveying path P, and is moved into the second conveying path Q through the communication path R. In the second conveying path Q, the developer is conveyed to the downstream side in the conveyance direction Y by the second developer conveying section 203. A part of the developer conveyed to the downstream side in the conveyance direction Y is borne on the surface of the developing roller 204, and the borne toner in the developer is moved to the photoreceptor drum 21 so as to be consumed sequentially. When the toner concentration detecting sensor 208 detects consumption of a predetermined amount of the toner, an unused toner is supplied into the second conveying path Q from the toner cartridge 300. The developer which is conveyed to the downstream side in the conveyance direction Y in the second conveying path Q is then moved into the pumping path S and is conveyed into the first conveying path P by the developer pumping section 209 disposed in the pumping path S.

In the pumping path S, the developer is pumped up by the developer pumping section 209 substantially to the vertically upper side against gravity. At this time, there occurs friction between the developer with the developer pumping section 209 or the vertical partition wall 207*b*, and as the result, the developer is charged. Then, a part of the developer pumped to the vertically upper part of the pumping path S is moved to the side of the first conveying path P while the other part of the developer is moved to the side of the second conveying path Q. Therefore, the other part of the developer is moved to the side of the second conveying path Q without passing through the first conveying path P, thereby returning into the pumping path S at a shorter distance compared with the case of passing through the first conveying path P.

In this manner, the developer circulates in a relatively short circulation path including the pumping path S in which the developer is charged and not including the first conveying path P. Therefore, the developing device 200 according to the embodiment is capable of fully charging and conveying a developer so that a good image can be formed stably with the image forming apparatus 100. Moreover, even a new toner which is freshly supplied into the developer tank 201 from the toner cartridge 300 can be charged immediately and sufficiently in the relatively short circulation path including the pumping path S.

Note that, in the case where a developer stored in the developer tank 201 is a two-component developer composed of a toner and a carrier, the two-component developer circulates in the relatively short circulation path including the pumping path S, and the two-component developer is thereby agitated. Accordingly, with the developing device 200, in the two-component developer, the toner and the carrier can be sufficiently mixed. Further, in the developing device 200, even a new toner which is freshly supplied to the developer tank 201 from the toner cartridge 300 can be mixed with a carrier immediately and sufficiently in the relatively short circulation path including the pumping path S.

In the embodiment, the developer pumping section 209 moves a part of the developer in the pumping path S into the first conveying path P through the second opening portion 207*d* disposed in the vertical partition wall 207*b*, while moving another part of the developer in the pumping path S into the second conveying path Q through the third opening portion 207*e* disposed in the vertical partition wall 207*d*. Therefore, the developer is circulation-conveyed in the circulation path composed of the second conveying path Q, the opening formed in the first opening portion 207*c*, the pumping path S, and the opening formed in the third opening portion 207*e*. Thereby, the whole size of the developing device 200 can be reduced compared with the case where there is another space between the second conveying path Q and the pumping path S. Furthermore, the developer, while being circulation-conveyed in this manner, falls down onto the second developer conveying section 203 through the third opening portion 207*e*, and in the case of the developer being aggregated, the aggregate can be disintegrated sufficiently. Note that, as another embodiment, the developer tank 201 may be configured so that another space is formed between the second conveying path Q and the pumping path S, and the developer may be circulation-conveyed in the circulation path composed of the other space, the opening formed in the first opening portion 207*c*, the pumping path S, and the opening formed in the third opening portion 207*e*.

Additionally, in the embodiment, the vertically lower part of the opening formed in the second opening portion 207*d* is disposed vertically above the vertically lower part of the first conveying path P. Therefore, the developer can be moved from the pumping path S into the first conveying path P more smoothly compared with a case where the vertically lower part of the opening formed in the second opening portion 207*d* is disposed vertically below the vertically lower part of the first conveying path P. Note that, in another embodiment, the vertically lower part of the opening formed in the second opening portion 207*d* does not need to be disposed vertically above the vertically lower part of the first conveying path P.

Further, in the embodiment, the vertically lower part of the pumping path S is disposed vertically below the vertically lower part of the second conveying path Q. Therefore, the developer can be moved into the pumping path S from inside the second conveying path Q more smoothly compared with the case where the vertically lower part of the pumping path S is disposed vertically above the vertically lower part of the second conveying path Q. Note that, as another embodiment, the vertically lower part of the pumping path S may be not disposed vertically below the vertically lower part of the second conveying path Q.

Further in the embodiment, a supply port section 205*a* is disposed vertically above a part facing the pumping path S in the second conveying path Q. Therefore, a new toner which is supplied at the supply port section 205*a* is guided into the pumping path S immediately. Accordingly, the developing device 200 can charge a new toner freshly supplied into the developer tank 201 immediately and sufficiently in the relatively short circulation path including the pumping path S.

Moreover, in the embodiment, the second developer conveying section 203 includes the rotating plates 203*c* disposed at a part facing the pumping path S in the second conveying path Q. Accordingly, the developer in the second conveying path Q can be guided into the pumping path S immediately by the rotating plates 203*c*. Thereby, the developer can be circulated efficiently in the relatively short circulation path including the pumping path S.

Further, in the embodiment, the face 207*f* vertically below the opening in the second opening portion 207*d* is formed to be inclined toward the horizontal surface so that a side of the first conveying path P comes to be the vertically lower side of a side of the pumping path S. Thereby, staying of the developer in the second opening portion 207*d* can be suppressed. Additionally, in the embodiment, the face 207*g* vertically below the opening in the third opening portion 207*e* is formed to be inclined toward the horizontal surface so that a side of the second conveying path Q comes to be the vertically lower side of a side of the pumping path S. Thereby, staying of the developer in the third opening portion 207*e* can be suppressed.

Next, description will be given for a developing device 400 according to a second embodiment. The developing device 400 has the same configuration as the developing device 200 except that a developer pumping section 210 is disposed in place of the developer pumping section 209, and therefore description for members other than the developer pumping section 210 will be omitted.

Figure 11:
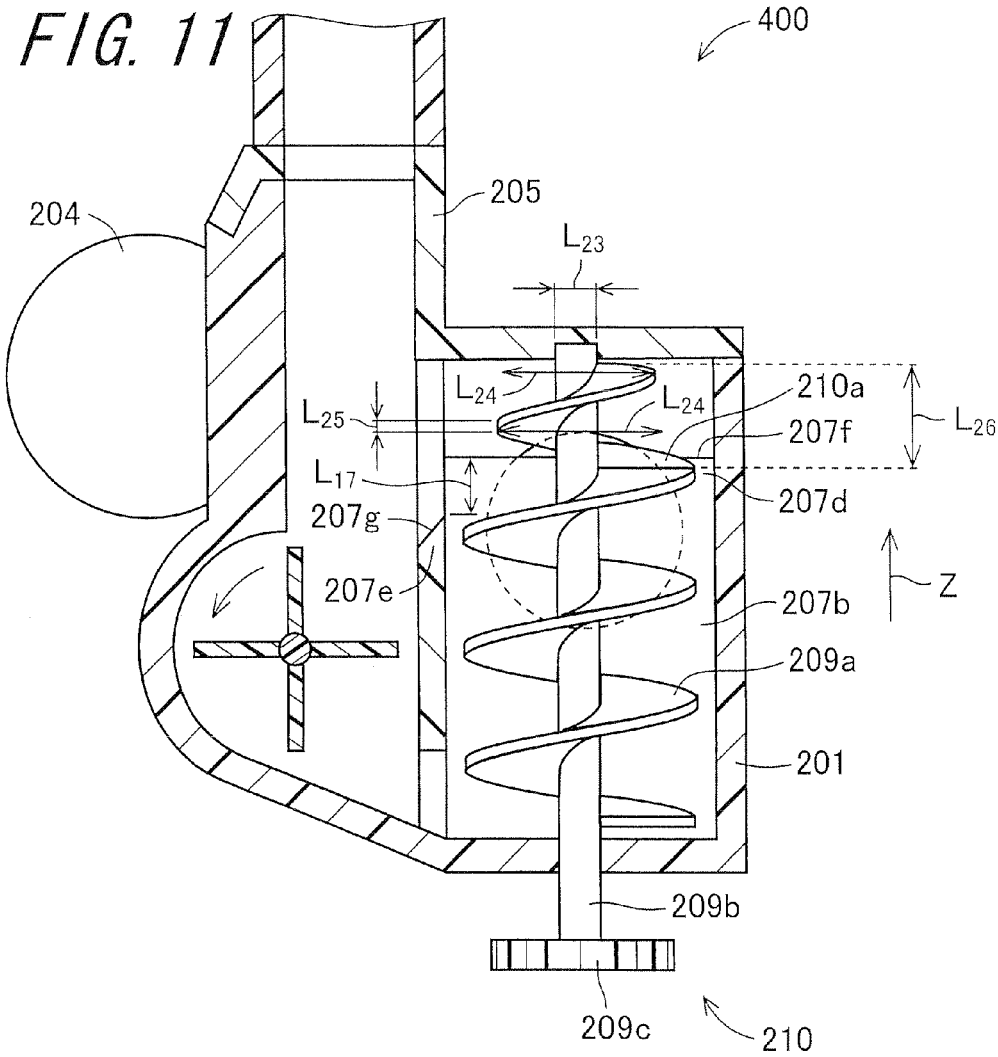
FIG. 11 is a schematic view showing a developer pumping section.

FIG. 11 is a schematic view showing the developer pumping section 210 and corresponds to FIG. 7. The developer pumping section 210 includes a pumping spiral blade 209*a*, a pumping rotation shaft member 209*b*, a pumping gear 209*c* and a cone-shaped pumping spiral blade 210*a*. Description about the pumping spiral blade 209*a*, the pumping rotation shaft member 209*b* and the pumping gear 209*c* will be omitted.

The pumping cone-shaped spiral blade 210*a* is continuously disposed at a vertically upper end of the pumping spiral blade 209*a*, rotates with the pumping spiral blade 209*a*, and pumps up by rotation a developer that is present in the vertically upper part of the pumping path S substantially to the vertically upper side. The cone-shaped pumping spiral blade 210*a* is disposed on the vertically upper side of the second opening portion 207*d* disposed in the vertical partition wall 207*b* and the third opening portion 207*e*. The cone-shaped pumping spiral blade 210*a* has a shape which has a constant internal diameter and an external diameter which becomes small continuously as it advances on the vertically upper side.

In the embodiment, the cone-shaped pumping spiral blade 210*a* is a continuous cone-shaped general spiral blade. In this embodiment, the "cone-shaped general spiral blade" is schematically a member in a shape in which an external diameter is continuously changed while maintaining an internal diameter constant in a general spiral blade. More specifically, the cone-shaped general spiral blade is a member with a predetermined thickness having a cone-shaped general spiral blade surface as described below as a main surface.

In this embodiment, the "cone-shaped general spiral blade surface" is a surface formed by the trajectory of one line segment $J_2$ outside an imaginary circular column $K_3$ (hereinafter, a radius is $r_2$) when the line segment $J_2$ is moved in one direction $D_2$ parallel to an axial line of the imaginary circular column $K_3$ while changing so that a length $m_3$ of the line segment $J_2$ in a radial direction of the imaginary circular column $K_3$ continuously becomes smaller and maintaining an attachment angle $\beta$ of the line segment $J_2$ along one general spiral $C_2$ (a lead angle is $\theta_2$) on a side surface of the imaginary circular column $K_3$. Here, the "attachment angle $\beta$" is an angle formed by the line segment $J_2$ and a half-line extending in the one direction $D_2$ from a tangent point of the line segment $J_2$ and the imaginary circular column $K_3$ on a plane including the axial line of the imaginary circular column $K_3$ and the line segment $J_2$, and is an angle that is larger than 0° and smaller than 180°.

Figure 12A:
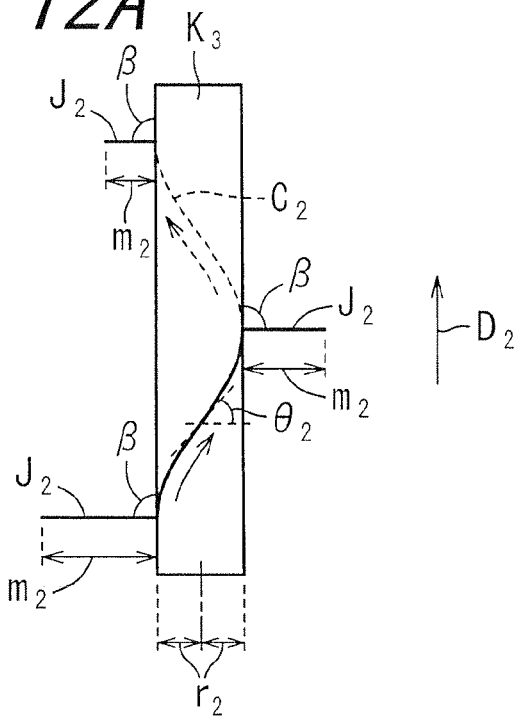

Hereinafter, as an example of the cone-shaped general spiral blade surface, a cone-shaped general spiral blade surface obtained when a line segment is moved along one cyclic portion of a general spiral (hereinafter, referred to as "one cyclic cone-shaped general spiral blade surface") is illustrated. FIGS. 12A to 12D are views illustrating the one cyclic cone-shaped general spiral blade surface. FIG. 12A shows a side surface of the imaginary circular column $K_3$, a right-handed general spiral $C_2$ on the side surface of the imaginary circular column $K_3$, and starting and end positions of the line segment $J_2$ moving in the one direction $D_2$ on the general spiral $C_2$. The line segment $J_2$ shown on the lowermost side of the sheet of FIG. 12A indicates the starting position in moving, and the line segment $J_2$ shown on the uppermost side indicates the end position. As shown in FIG. 12A, the trajectory of the line segment $J_2$ when the line segment $J_2$ is moved in the one direction $D_2$ along the general spiral $C_2$ while changing so that a length $m_3$ of the line segment $J_2$ in a radial direction of the imaginary circular column $K_3$ continuously becomes smaller and constantly maintaining the attachment angle $\beta$ ($\beta$=90° in FIG. 12A) of the line segment $J_2$ corresponds to a cone-shaped general spiral blade surface.

Figure 12B:
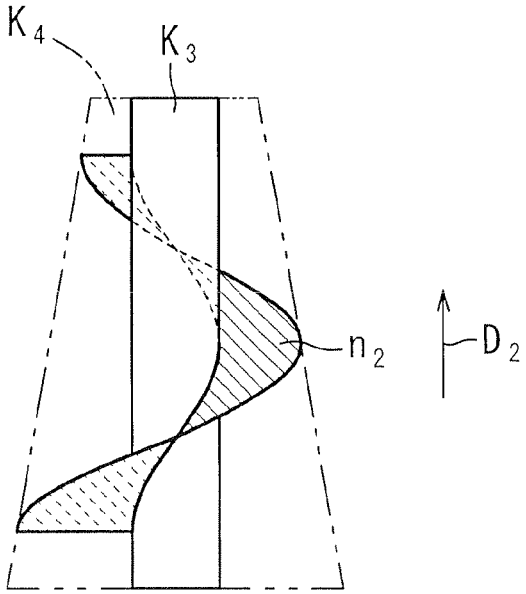
Figure 12C:
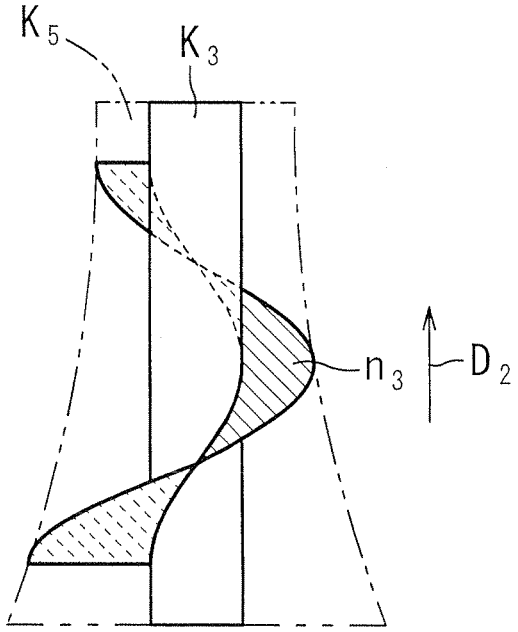

As shown in FIGS. 12B to 12D, an outer circumferential portion of the cone-shaped general spiral blade surface inscribes the side surface of an imaginary truncated cone having the same axial line as the imaginary circular column $K_3$. In this embodiment, the "truncated cone" as used herein is a solid having two bottom surfaces whose areas are different from each other, whose axial line runs through the two bottom surfaces, and whose external diameter continuously becomes smaller as advancing in one direction of the axial line directions thereof. The shape of the imaginary truncated cone inscribed by the cone-shaped general spiral blade surface differs depending on the way that the length $m_3$ of the line segment $J_2$ changes. Further, in the embodiment, the outer circumferential portion of the cone-shaped general spiral blade surface is a portion which is the most distant from the axial line of the imaginary truncated cone on the general spiral blade surface.

FIG. 12B shows a cone-shaped general spiral blade surface $n_2$ inscribing an imaginary right circular truncated cone $K_4$. In this embodiment, the "right circular truncated cone" is a solid which is not a circular cone among two solids obtained by dividing a right circular cone on one plane parallel to the bottom surface. The trajectory of the line segment $J_2$ when the rate of change of the length $m_2$ of the line segment $J_2$ per unit moving distance along the general spiral $C_2$ is constant, corresponds to the cone-shaped general spiral blade surface $n_2$ depicted by the hatched portion in FIG. 12B, and the outer circumferential portion thereof inscribes the side surface of the imaginary right circular truncated cone $K_4$.

FIG. 12C shows a cone-shaped general spiral blade surface $n_3$ inscribing an imaginary compressed right circular truncated cone $K_5$. In this embodiment, the "compressed right circular truncated cone" is a solid having such a shape that the side surface of a right circular truncated cone is curved in a direction towards the axial line. The trajectory of the line segment $J_2$ when the rate of change of the length $m_3$ of the line segment $J_2$ per unit moving distance along the general spiral $C_2$ becomes gradually smaller as advancing in one direction $D_2$, corresponds to the cone-shaped general spiral blade surface $n_3$ depicted by the hatched portion in FIG. 12C, and the outer circumferential portion thereof inscribes the side surface of the imaginary compressed right circular truncated cone $K_5$.

FIG. 12D shows a cone-shaped general spiral blade surface $n_4$ inscribing an imaginary expanded right circular truncated cone $K_6$. In this embodiment, the "expanded right circular truncated cone" is a solid having such a shape that the side surface of a right circular truncated cone is curved in a direction away from the axial line. The trajectory of the line segment $J_2$ when the rate of change of the length $m_3$ of the line segment $J_2$ per unit moving distance along the general spiral $C_2$ becomes gradually larger as advancing in one direction $D_2$, corresponds to the cone-shaped general spiral blade surface $n_4$ depicted by the hatched portion in FIG. 12D, and the outer circumferential portion thereof inscribes the side surface of the imaginary expanded right circular truncated cone $K_6$.

The member with such a cone-shaped general spiral blade surface as the main surface is the cone-shaped general spiral blade. In a case where the cone-shaped general spiral blade is used as the cone-shaped pumping spiral blade 210*a* as in the embodiment, the cone-shaped general spiral blade is disposed so that the cone-shaped general spiral blade surfaces $n_2$, $n_3$ and $n_4$ are located on the vertically upper side. The developer is conveyed to the vertically upper side by the cone-shaped general spiral blade surfaces $n_2$, $n_3$ and $n_4$.

Further, in a case where the cone-shaped general spiral blade is used as the cone-shaped pumping spiral blade 210*a*, an internal diameter $L_{23}$ of the cone-shaped pumping spiral blade 210*a* (the cone-shaped general spiral blade) becomes a value of two times the radius $r_2$ of the imaginary circular column $K_3$ as shown in FIG. 12A, and an external diameter $L_{24}$ thereof is continuously changed from maximum value of $2m_2+2r_2$ to minimum value of $2m_2+2r_2$ as it advances on the vertically upper side, as shown in FIGS. 12B to 12D. Here, the internal diameter $L_{23}$ of the cone-shaped pumping spiral blade 210*a* (cone-shaped general spiral blade) is a value of two times a distance between an inner circumferential portion of the cone-shaped pumping spiral blade 210*a* (cone-shaped general spiral blade) and an axial line of the imaginary circular column $K_3$, and the inner circumferential portion is a part on the cone-shaped pumping spiral blade 210*a* (cone-shaped general spiral blade) in which the distance from the axial line of the imaginary circular column $K_3$ is the closest thereto in a cross section perpendicular to the axial line of the imaginary circular column $K_3$. Further, the external diameter $L_{24}$ of the cone-shaped pumping spiral blade 210*a* (cone-shaped general spiral blade) is a value of two times a distance between an outer circumferential portion of the cone-shaped pumping spiral blade 210*a* (cone-shaped general spiral blade) and the axial line of the imaginary circular column $K_3$, and the outer circumferential portion is a part on the cone-shaped pumping spiral blade 210*a* (cone-shaped general spiral blade) in which the distance from the axial line of the imaginary circular column $K_3$ is the most distant therefrom in the cross section perpendicular to the axial line of the imaginary circular column $K_3$.

The internal diameter $L_{23}$ of the cone-shaped pumping spiral blade 210*a* is settable as appropriate in the range of 5 mm or more and 15 mm or less, for example. The minimum value of the external diameter $L_{24}$ of the cone-shaped pumping spiral blade 210*a* is settable as appropriate in the range of 6 mm or more and 20 mm or less, for example, and the maximum value thereof is settable as appropriate in the range of 15 mm or more and 33 mm or less, for example. Further, for example, the attachment angle $\beta$ may not be 90°, and is settable as appropriate in the range of 30° or more and 150° or less. The lead angle $\theta_2$ is settable as appropriate in the range of 20° or more and 70° or less, for example. Further, a thickness $L_{25}$ of the cone-shaped pumping spiral blade 210*a* is settable as appropriate in the range of 1 mm or more and 3 mm or less, and an entier length $L_{26}$ of the cone-shaped pumping spiral blade 210*a* in the longitudinal direction thereof is settable as appropriate in the range of 40 mm or more and 100 mm or less.

In the embodiment, the maximum value of the external diameter $L_{24}$ of the cone-shaped pumping spiral blade 210*a* is equal to the external diameter $L_{20}$ of the pumping spiral blade 209*a*, and the internal diameter $L_{23}$ of the cone-shaped pumping spiral blade 210*a* is equal to the internal diameter $L_{19}$ of the pumping spiral blade 209*a*. Accordingly, the cone-shaped pumping spiral blade 210*a* is smoothly connected to the pumping spiral blade 209*a*.

According to the developing device 400 provided with such a developer pumping section 210, the cone-shaped pumping spiral blade 210*a* is disposed vertically above the second opening portion 207*d* disposed in the vertical partition wall 207*b* and the third opening portion 207*e*, and thus the developer can be pumped to a position vertically above the second opening portion 207*d* and the third opening portion 207*e*.

Furthermore, since the cone-shaped pumping spiral blade 210*a* has a shape which has a constant internal diameter and an external diameter which becomes small continuously as it advances on the vertically upper side, an amount of the developer conveyed by the cone-shaped pumping spiral blade 210*a* can be reduced as it advances on the vertically upper side. Thereby, the developer can be prevented from being compressed by holding the developer between the cone-shaped pumping spiral blade 210*a* and the developer tank cover 205.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device for storing a developer and supplying the developer to an image bearing member to develop an electrostatic latent image on the image bearing member, comprising:

a developer tank which stores therein the developer;

a partition wall which divides an internal space of the developer tank into:

a first conveying path which is located along a longitudinal direction of the partition wall and extends in a substantially horizontal direction, a second conveying path which extends in the substantially horizontal direction and faces the first conveying path with the partition wall interposed therebetween, a communication path through which the first conveying path and the second conveying path communicate with each other on one end side in the longitudinal direction of the partition wall, and a pumping path through which the first conveying path and the second conveying path communicate with each other on another end side in the longitudinal direction of the partition wall and which extends in a substantially vertical direction;

a first developer conveying section disposed in the first conveying path, the first developer conveying section conveying the developer in the developer tank in the substantially horizontal direction, the first developer conveying section conveying the developer from the other end side to the one end side in the longitudinal direction of the partition wall;

a second developer conveying section disposed in the second conveying path, the second developer conveying section conveying the developer in the developer tank in the substantially horizontal direction, the second developer conveying section conveying the developer from the one end side to the other end side in the longitudinal direction of the partition wall; and a developer pumping section disposed in the pumping path, the developer pumping section pumping the developer in the pumping path toward an upper side in the substantially vertical direction of the pumping path, the developer pumping section moving part of the developer to a side of the first conveying path by pumping the developer in the pumping path, while moving other part of the developer to a side of the second conveying path, wherein the partition wall further comprises:

a first opening portion in which an opening through which the second conveying path communicates with the pumping path is formed at a vertically lower part of the partition wall;

a second opening portion in which an opening through which the first conveying path communicates with the pumping path is formed at a vertically upper part of the partition wall; and a third opening portion in which an opening through which the second conveying path communicates with the pumping path is formed at the vertically upper part of the partition wall; and wherein the second developer conveying section is configured to move the developer in the second conveying path into the pumping path through the first opening portion, and the developer pumping section is configured to move the part of the developer in the pumping path into the first conveying path through the second opening portion, while moving the other part of the developer into the second conveying path through the third opening portion.

2. The developing device of claim 1, wherein a vertically lower part of the opening formed in the second opening portion is disposed vertically above a vertically lower part of the first conveying path.

3. The developing device of claim 1, wherein a vertically lower part of the pumping path is disposed vertically below a vertically lower part of the second conveying path.

4. An electrophotographic image forming apparatus comprising the developing device of claim 1.

* * * * *